US010741353B2

(12) United States Patent
Kenmotsu et al.

(10) Patent No.: US 10,741,353 B2
(45) **Date of Patent: *Aug. 11, 2020**

(54) ELECTRON EMITTING CONSTRUCT CONFIGURED WITH ION BOMBARDMENT RESISTANT

(71) Applicant: NANO-X IMAGING LTD, Neve-Ilan (IL)

(72) Inventors: Hidenori Kenmotsu, Machida (JP); Hitoshi Masuya, Kashiwa (JP); Koichi Iida, Kayabe (JP)

(73) Assignee: NANO-X IMAGING LTD, Neve-Ilan (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,837

(22) Filed: Mar. 25, 2019

(65) Prior Publication Data

US 2019/0221398 A1 Jul. 18, 2019

Related U.S. Application Data

(63) Continuation of application No. 15/038,737, filed as application No. PCT/IB2014/066361 on Nov. 26, 2014, now Pat. No. 10,269,527.

(60) Provisional application No. 62/013,567, filed on Jun. 18, 2014, provisional application No. 61/909,387, filed on Nov. 27, 2013.

(51) Int. Cl.

| | |
|---|---|
| ***H01J 35/06*** | (2006.01) |
| ***H01J 35/08*** | (2006.01) |
| ***H01J 1/304*** | (2006.01) |
| ***H01J 35/14*** | (2006.01) |

(52) U.S. Cl.

CPC ..... *H01J 35/065* (2013.01); *H01J 35/08* (2013.01); *H01J 35/14* (2013.01); *H01J 1/3042* (2013.01); *H01J 2235/062* (2013.01); *H01J 2235/086* (2013.01)

(58) Field of Classification Search

CPC ..... H01J 1/3042; H01J 2235/062; H01J 2235/086; H01J 35/065; H01J 35/08; H01J 35/14

See application file for complete search history.

(56) References Cited

U.S. PATENT DOCUMENTS 5,773,921 A * 6/1998 Keesmann ..... H01J 1/3042 313/309
6,642,648 B1 * 11/2003 Cooper ..... H01J 9/261 313/491

(Continued)

FOREIGN PATENT DOCUMENTS

JP 2000048743 A * 2/2000

*Primary Examiner* — Chih-Cheng Kao

(74) *Attorney, Agent, or Firm* — AlphaPatent Associates, Ltd.; Daniel J. Swirsky

(57) ABSTRACT

A robust cold cathode uses an electron emitting construct design possibly for an x-ray emitter device. The electron beam emitted by the emitting construct is focused and accelerated by an electrical field towards an electron anode target. A shield is provided to prevent a cold cathode from being damaged by ion bombardment in high-voltage applications and a non-emitter zone may provide a robust ion bombardment zone. The system is further configured to provide an angled target anode or a stepped target anode to further reduce the ion bombardment damage.

9 Claims, 16 Drawing Sheets

(56) References Cited

U.S. PATENT DOCUMENTS

| | | | | |
|---|---|---|---|---|
| 10,269,527 | B2 * | 4/2019 | Kenmotsu | H01J 35/08 |
| 2003/0057534 | A1 * | 3/2003 | Ho | H01L 23/3128 257/678 |
| 2009/0185660 | A1 * | 7/2009 | Zou | H01J 1/3048 378/122 |
| 2009/0310743 | A1 * | 12/2009 | Carpenter | C12Q 1/004 378/45 |
| 2012/0057669 | A1 * | 3/2012 | Vogtmeier | H01J 35/06 378/4 |

* cited by examiner

Beam Landing Simulation

1400B without step
(Angled anode)

with step
(Stepped anode)

ELECTRON EMITTING CONSTRUCT CONFIGURED WITH ION BOMBARDMENT RESISTANT

CROSS-REFERENCE TO RELATED APPLICATIONS

This application is a continuation of U.S. patent application Ser. No. 15/038,737, filed May 24, 2016, which is a National Phase Patent Application under 35 U.S.C. 371 of International Patent Application No. PCT/IB2014/066361, which has an international filing date of Nov. 26, 2014, and which claims priority and benefit from U.S. Provisional Patent Application No. 61/909,387, filed Nov. 27, 2013, and U.S. Provisional Patent Application No. 62/013,567, filed Jun. 18, 2014, the contents and disclosure of which are incorporated herein by reference in their entirety.

FIELD OF THE INVENTION

The present disclosure is directed to providing a field emitter for an x-ray source and an electron emitting construct for a device, such as an image capture device or an x-ray emitter, comprising field emission type electron sources. In particular, the electron emitting construct is configured to facilitate radiation in the X-ray spectrum and further relates to a system and method for preventing a cold cathode from being damaged by ion bombardment in high-voltage applications.

BACKGROUND OF THE INVENTION

Typically, an imaging device using a photoelectric layer in combination with an array of field emission type electron sources employs passive matrix activation or active matrix activation. In certain known active matrix activation methods, a particular electron source is activated through the use of two lines, a column selection line (e.g., from a column scanning driver) and a row selection line (e.g. from a row scanning driver), where of one of signal lines also serves as the voltage source to provide power to the selected electron source. In the case of field emission type electron source arrays employing such an activation system, the selection/voltage source line requires the capability of handling a voltage of tens of volts. When such high voltages are used in a signal selection circuit, the consumption of electric power due to the switching activity becomes extremely high, because the level of electric consumption is a function of a square of the voltage. Further, when the voltage in the signal line is large, the ability of the switching circuit to operate under a fast response time is adversely affected due to distortion of the voltage waveform.

In certain hold-type display devices using active matrix activation, the voltage source is separate from the two selection lines (column and row). That is, a particular electron source is activated through the activation of a first signal line and a second signal line, in addition to the voltage for activating the electron source being provided through a third voltage supply line. Typically, one of the two signal lines provides signals of varying voltages to control the length of electron source activation and thus the level of total electron emission (e.g., to control the pixel display intensity). Consequently, the voltage of the signal line carrying the pixel intensity signal may be large, e.g., 15 volts, which results in high energy consumption and a degradation of the response time capability of the switching circuit. Further, the switching time of the activation transistor is limited by the charging time and the charging capacity of the associated capacitor. For these reasons, such systems are not well suited for high speed operations such as dot by dot (or line by line) sequential activation.

Further, X-rays are a form of electromagnetic radiation, which are typically generated by an x-ray generator. An x-ray generator is a device used to generate x-rays, typically used in radiography to acquire an x-ray image representing the inside of an object enabling imaging of the human body for diagnosis or treating medical problems, for example. X-ray technology may further be used, apart from medicine, in fields such as non-destructive testing, sterilization, florescence and the like.

X-ray tubes, typically comprise a cathode assembly configured to emit electrons into the vacuum and an anode assembly configured to collect the electrons and the tube housing, thus establishing a flow of electrical current, known as the electron beam, through the tube. A high voltage power source is connected across the cathode and the anode to accelerate the electrons, striking the target at high speed after being accelerated. The electron beam is focused and strikes the anode target at a focal spot. Thus, electrons from the cathode collide with the anode material, such as tungsten, molybdenum or copper, and accelerate other electrons, ions and nuclei within the anode material. About 1% of the energy generated is emitted/radiated, usually perpendicular to the path of the electron beam, as x-rays. The rest of the energy is released as heat.

It is particularly noted that a typical x-ray source has a filament type hot cathode for its emitter, which is heated by an electric current passing through the filament. Another type of cathode that is not electrically heated by a filament is a cold cathode, which may be used as a replacement for the hot cathode. However cold cathode x-ray sources lack robustness in high voltage applications.

In high voltage applications using an emitter such as an x-ray source, some of the (de)gas molecules from the anode are ionized and accelerated in a beam of ions towards the emitting cathode. This beam can cause severe damage to the emitters due to the high energy ion bombardment.

There is a need for a robust cold cathode resilient to such ion bombardments in high voltage applications. The current disclosure addresses this need.

SUMMARY OF THE INVENTION

According to one aspect of the presently disclosed subject matter, there is provided an electron emitting construct comprising:

- an array of field emission type electron sources and a plurality of control contacts configured for controlling the electron sources;
- a focus electrode configured for applying a voltage above the array; and
- a shield disposed over the control contacts.

The shield may constitute part of the focus electrode.

The electron sources may be nano-Spindt emitters.

The electron emitting construct may further comprise an electrically insulating substrate. The substrate may be made of a ceramic material.

The electron emitting construct may further comprise an emitter chip mounted to a top-facing chip-mounting surface of the substrate, the array and control contacts being disposed on a top side of the emitter chip.

The substrate may comprise control vias corresponding to each of the control contacts, wherein a top end of each via is disposed below the shield.

The emitter chip may comprise a plurality of vias configured to facilitate bringing each of the control contacts into electrical communication with its corresponding control via.

The electron emitting construct may further comprise a plurality of external conductors, connecting between each of the control contacts and its corresponding control via.

The substrate may comprise one or more vias configured to facilitate bringing a bottom surface the emitter chip into electrical communication with a bottom surface of the substrate.

The substrate may be configured to bring the focus electrode into electrical communication with a bottom surface of the substrate.

According to another aspect of the presently disclosed subject matter, there is provided an image capture device comprising an electron emitting construct as described above.

According to another aspect of the presently disclosed subject matter, there is provided an x-ray emitting device comprising an electron emitting construct as described above.

According to another aspect of the presently disclosed subject matter, there is provided an x-ray emitter device, comprising:

an electron anode target, producing an electric field adjacent to its surface; and a cold cathode electron source having at least one electron emitting zone configured to emit electrons towards said electron anode target;

The x-ray emitter device further comprises:

at least one ion bombardment zone disposed along a line perpendicular to the electric field adjacent to the surface of the electron anode target; the at least one ion bombardment zone being distinct from the electron emitting zone of the cold cathode electron source.

The x-ray emitter device further comprising a focus structure configured to direct the electrons towards the electron anode target such that the electrons strike an electron focal spot at an angle.

As appropriate, the at least one ion bombardment zone of the x-ray emitter device is disposed along a line perpendicular to the surface of the electron anode target at the electron focal spot.

As appropriate, the at least one ion bombardment zone of the x-ray emitter device has larger dimensions than the electron focal spot.

The at least one ion bombardment zone of the x-ray emitter device may be coated with an elemental material. The elemental material may be selected from a group including a pure metal and carbon.

The at least one ion bombardment zone of the x-ray emitter device may comprise a central region surrounded by the electron emitting zone of the cold cathode electron source.

The non-emitter zone of the x-ray emitter device is set between constructs of the emitting zones of the cold cathode electron source.

The electrically insulating emitter substrate of the x-ray emitter device further comprising an emitter chip mounted to a top-facing chip-mounting surface of the electrically insulating emitter substrate.

The electron anode target of the x-ray emitter device may comprise an angled electron anode target configured to form an angle to the electron emitting source. Where appropriate, the electron angled anode may further comprise a step to form a stepped electron anode.

The focus structure of the x-ray emitter may be operable to direct the electrons to a focal spot close to the step.

The angle of the angled electron anode target of the x-ray emitter device may be selected such that the ion bombardment zone is outside an emitter area of the cold cathode electron source.

The electron emitting zone of the x-ray emitter device may comprise a plurality of field emission type electron sources.

The field emission type electron source of the x-ray emitter device may be a Spindt-type electron source.

The x-ray emitter device further comprising a resistive layer situated between the field emission type electron source and the cathode.

The substrate of the x-ray emitter device may be silicon-based or silicon carbide-based.

BRIEF DESCRIPTION OF THE DRAWINGS

For a better understanding of the invention and to show how it may be carried in practice, reference will now be made, purely by way of a non-limiting example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DETAILED DESCRIPTION

Figure 1:
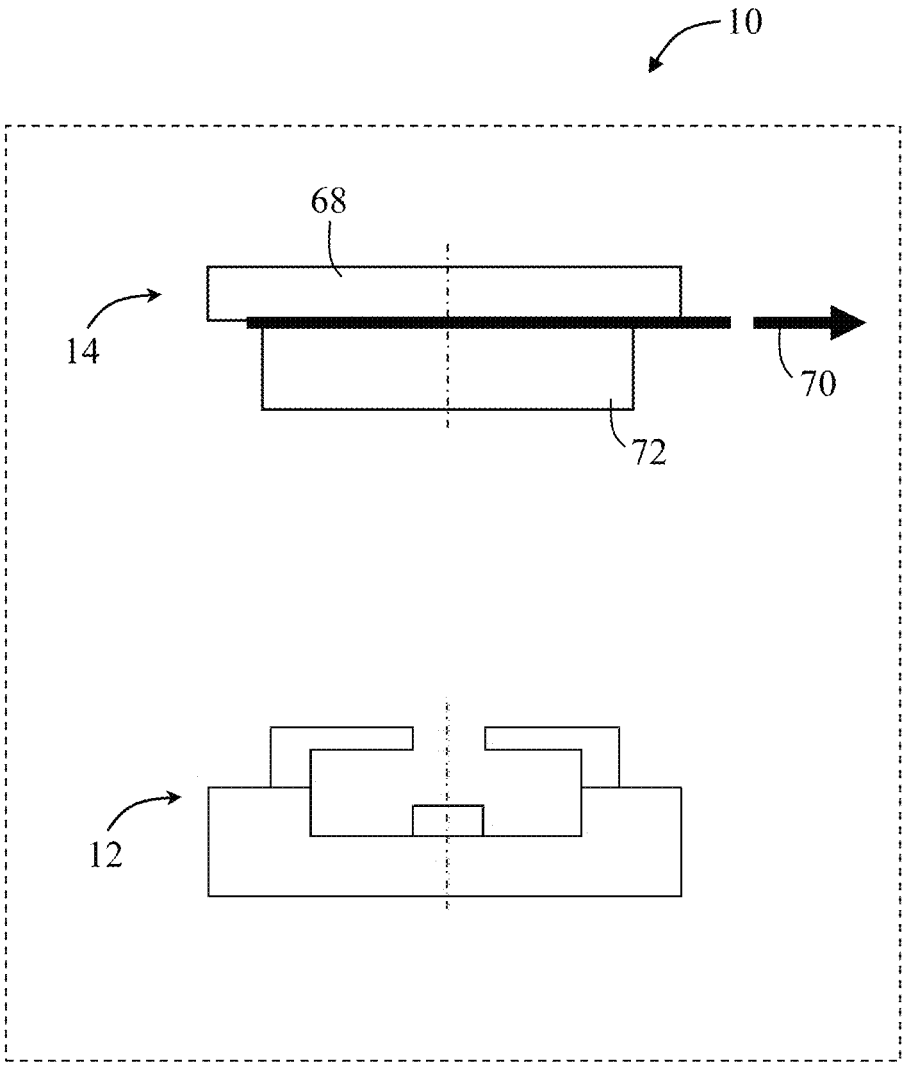
FIG. 1 is a schematic drawing of a device according to the presently disclosed subject matter.

Electron Emitting Construct:

As illustrated schematically in FIG. 1, there is provided a device, which is generally indicated as 10. The device 10 comprises an electron emitting construct 12, constituting a cold cathode of the emitter, and an electron receiving construct 14, constituting an anode of the emitter. Electron emitting construct 12 is configured for emitting an electron beam toward the electron receiving construct 14, which then produces radiation in a predetermined spectrum, as is described below. The device may be, for example, an x-ray emitter, an image capture device, etc.

Figure 2A:
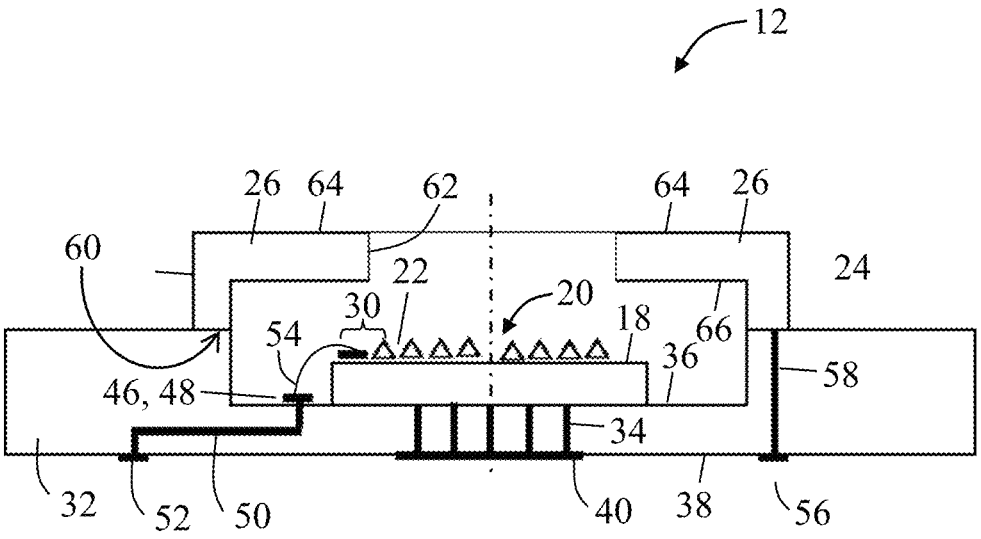
FIGS. 2A and 2B are side sectional views of examples of electron emitting constructs of the image capture device illustrated in FIG. 1.
Figure 2B:
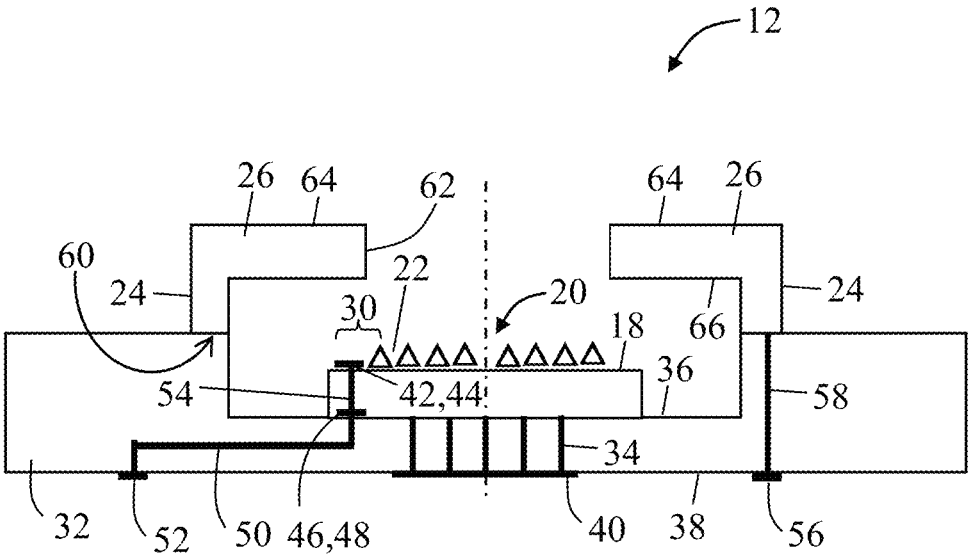

As illustrated in FIGS. 2A and 2B, the electron emitting construct 12 comprises an emitter chip 18 to which an array 20 of field emission type electron sources 22 is mounted. A focus electrode 24, comprising an overhang 26 partially disposed over the emitter chip 18 and being formed with an opening 28, is disposed above the electron emitting construct 12. In particular, the overhang 26 is disposed over a margin area 30 of the emitter chip 18, while the opening 28 is disposed over the array 20 of field emission type electron sources 22. The electron emitting construct 12 and the focus electrode 24 are mounted on an electrically insulated substrate 32.

The electron sources 22 may be any element suitable for selectively generating electron beam, for example by quantum mechanical tunneling. Non-limiting examples of suitable electron sources 22 include nano-Spindt emitters, carbon nanotube type electron sources, metal-insulator-metal type electron sources, metal-insulator-semiconductor type electron sources. Alternatively, the array may comprise a combination of different types of electron sources 22.

The substrate 32 may be made of any suitable material which provides electrical insulation. For example, it may be made of ceramic.

In order to power the emitter chip 18, the substrate 32 is provided with one or more chip vias 34, which bring a top-facing chip-mounting surface 36 of the substrate 32 into electrical communication with a bottom surface 38 thereof. (In the present disclosure, the terms "upper", "top", "lower", "bottom", and similar terms are used with reference to the orientation illustrated in the reference to figure.) An electrically conductive contact plate 40 is provided at the bottom surface 38. Thus, a power source may be used to provide the necessary electrical power to the emitter chip 18 by utilizing the contact plate 40 and chip vias 34 to connect to the emitter chip.

Figure 3:
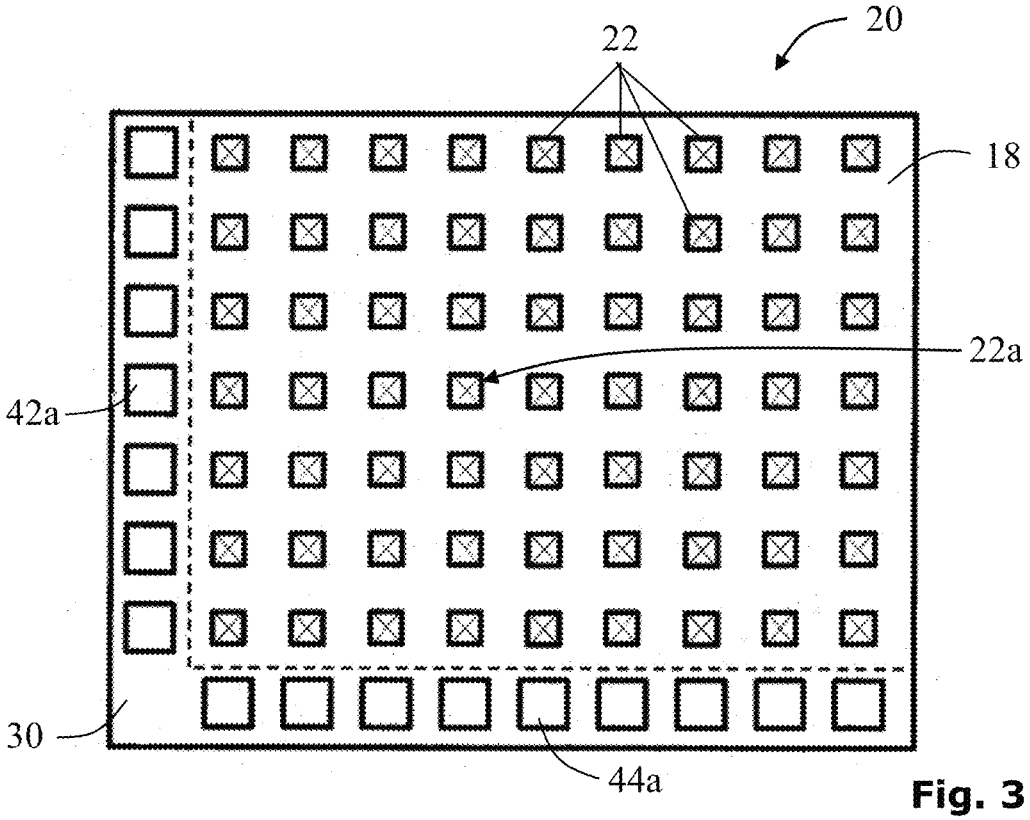
FIG. 3 is a top view of an emitter chip of the electron emitting constructs illustrated in FIGS. 2A and 2B.

As illustrated schematically in FIG. 3, the emitter chip 18 comprises a plurality of row control contacts 42 along one side thereof, and column control contacts 44 along with an adjacent side thereof. The control contacts 42, 44 are disposed within the margin area 30 of the emitter chip 18, and are thus shielded by the overhang 26 of the focus electrode 24. They define a grid on which the field emission type electron sources 22 are arranged. Each of the electron sources 22 are controlled by activating both its respective row control contact 42 and column control contact 44. For example, the electron source 22 indicated at 22*a* may be controlled by activating the row control contact indicated at 42*a* and the column control contact indicated at 44*a*.

Figure 4A:
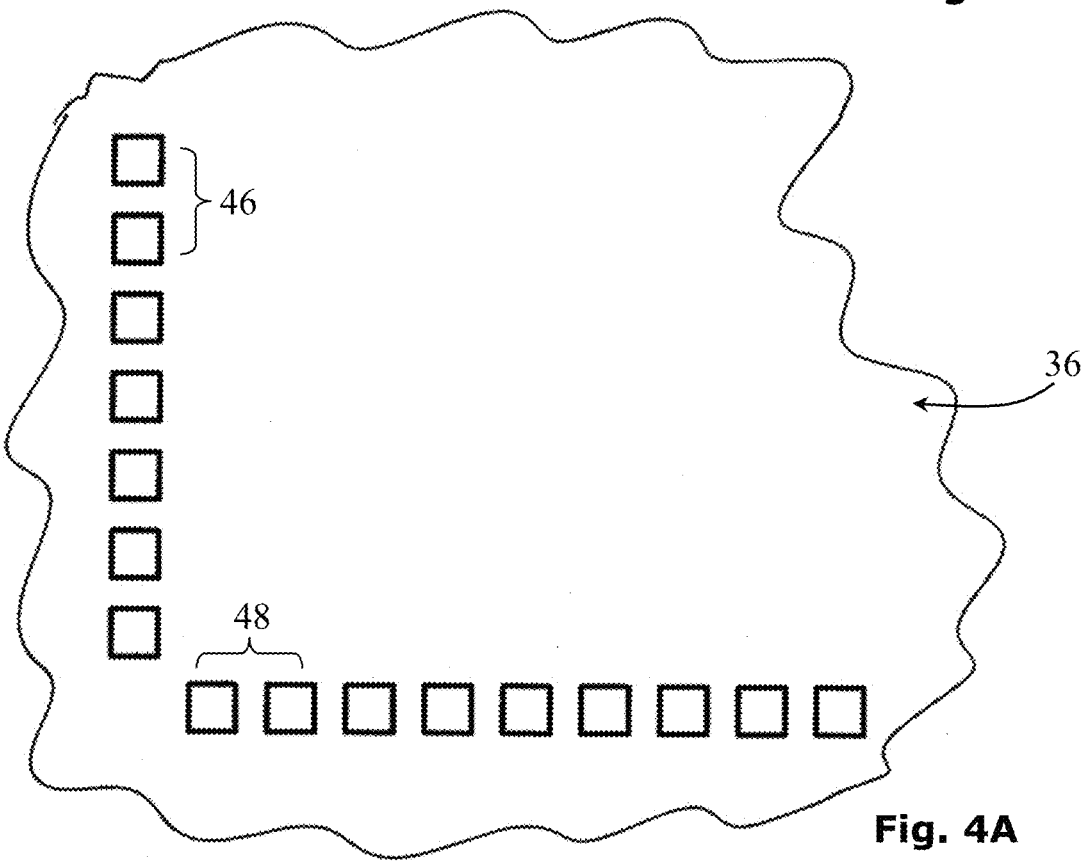
FIG. 4A is a plan view of a portion of a chip-mounting surface of a substrate of the electron emitting constructs illustrated in FIGS. 2A and 2B.
Figure 4B:
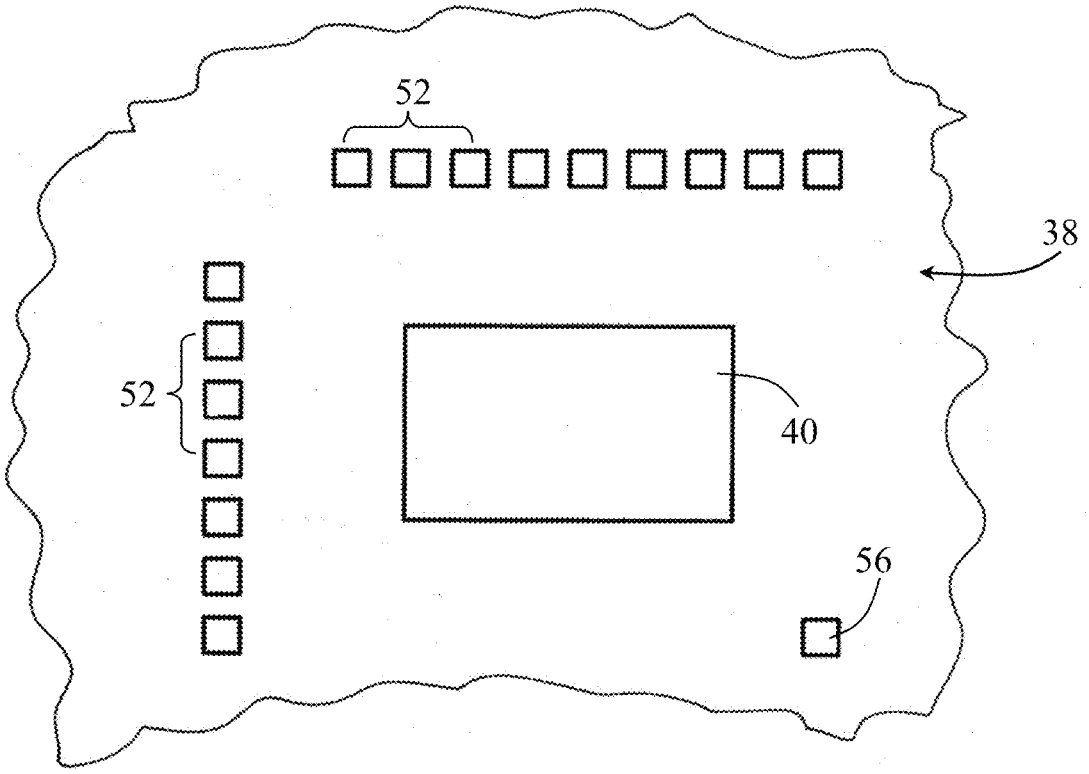
FIG. 4B is a plan view of a portion of a bottom surface of the substrate.

As illustrated in FIG. 4A, the chip-mounting surface 36 of the substrate 32 is provided with a plurality of row control pads 46, e.g., arranged in a line, corresponding to the row control contacts 42 of the emitter chip 18, and a plurality of column control pads 48, e.g., arranged in a line substantially perpendicular to the line of row control pads, corresponding to the column control contacts 44 of the emitter chip. Reverting to FIGS. 2A and 2B, each of the control pads 46, 48 are electrically connected to the bottom surface 38 (illustrated in FIG. 4B) of the substrate 32 by a control via 50 (illustrated in FIGS. 2A and 2B). Each control via 50 extends between the control pads 46, 48 at a top end thereof, and an emitter drive pad 52, is configured for being connected to a controller (not illustrated) such as a driving circuit or other similar device configured to direct operation of the emitter chip 18, at a bottom end thereof.

Reverting to FIGS. 2A and 2B, the row and column control contacts 42, 44 located on the top side of the emitter chip 18 are connected, respectively, to the row and column control pads 46, 48. According to one example, as illustrated in FIG. 2A, each contact 42, 44 may electrically connected to its respective control pad 46, 48 via an external conductor 54. The conductors 54 may be wires, solid leads, or any other suitable connecting element. According to another example, as illustrated in FIG. 2B, the emitter chip 18 may be provided with a through-silicon via (TSV) 54 associated with each of the control contact 42, 44. The TSV's 54 associated with each of the control contacts 42, 44 are each connected to the respective control pad 46, 48.

The above examples ensure that the electrical path between the emitter drive pad 52 and the control contact the 42, 44 are completely shielded by the overhang 26 of the focus electrode 24.

The focus electrode 24 is configured to correct the trajectory of electrons emitted from the electron sources 22, while minimizing loss of electrons emitted at undesirable trajectories. Accordingly, it is configured to apply a focus voltage across the opening 28 defined thereby, through which electrons emitted by the electron sources 22 reach the electron receiving construct 14.

Thus, a focus pad 56, configured for being connected to the controller, is provided on the bottom surface 38 of the substrate 32. A focus via 58 is provided, electrically connecting the focus electrode 24 with the focus pad 56. The focus electrode 24 is made of an electrically conductive material, enabling it to apply the focus voltage at the opening 28.

According to a modification (not illustrated), the bottom surface 60 and opening-facing surface 62 of the focus electrode 24 are in electrical contact with one another, with at least one or both of the upwardly-facing surface 64 and a downwardly-facing surface 66 thereof comprising an electrically insulating material.

The electron receiving construct 14 may be provided according to any suitable design. For example, as illustrated in FIG. 1, it may comprise a faceplate 68, an anode 70, and a downwardly-facing radiation source 72, such as a metal target in the case of an x-ray emitter, or a photoconductor in the case of an image capture device, as is known in the art.

Figure 5A:
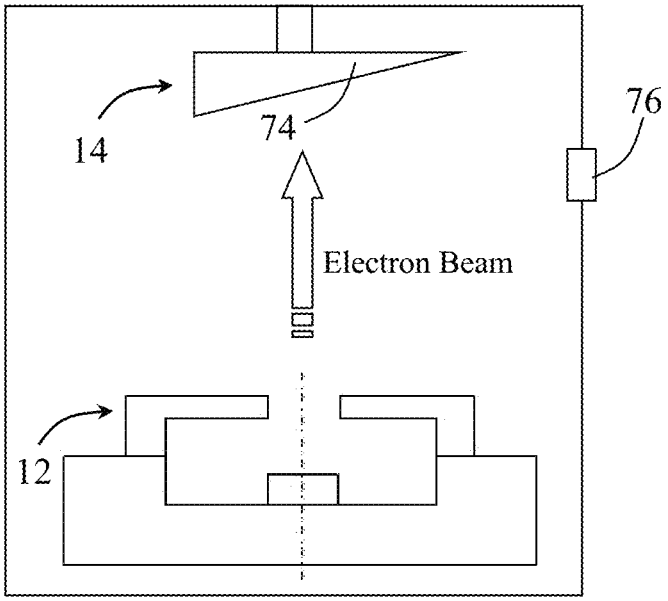
FIG. 5A is a schematic drawing of an example of a reflection-type device according to the presently disclosed subject matter.

It will be appreciated that the device 10 described herein with reference to the accompanying figures may include any suitable electron receiving construct without departing from the scope of the presently disclosed subject matter, mutatis mutandis. For example, as illustrated in FIG. 5A, the device 10 may be a reflection-type. According to this example, the electron receiving construct 14 comprises an angled surface 74 facing between the electron emitting construct 12 and an output aperture 76. When an electron beam emitted from the electron emitting construct 12 strikes the electron receiving construct 14, radiation of a predetermined spectrum determined by the makeup of the radiation source 72, e.g., x-rays, is produced. The disposition of the angled surface 74 relative to the electron emitting construct 12 and the output aperture 76 is selected so that the radiation exits via the output aperture.

Figure 5B:
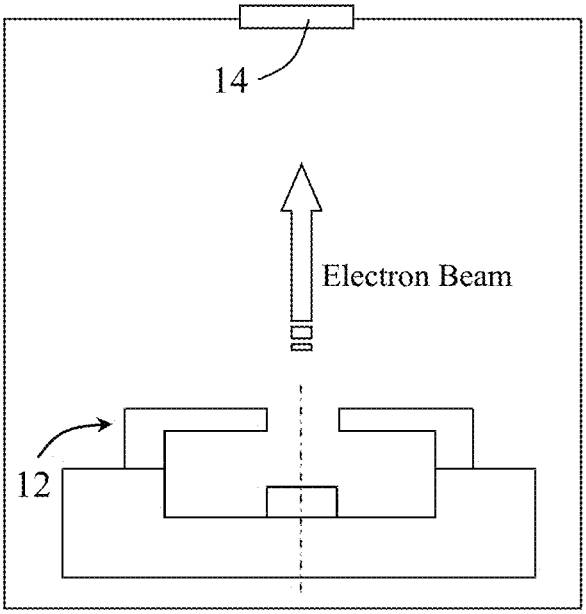
FIG. 5B is a schematic drawing of an example of a transmission-type device according to the presently disclosed subject matter.

According to another example, illustrated in FIG. 5B, the device 10 is a transmission type. According to this example, the electron receiving construct 14 is disposed substantially perpendicular to the direction at which the electron emitting construct 12 emits electrons. According to this example, the radiation source 72 of the electron receiving construct 14 faces away from the electron emitting construct 12 When an electron beam emitted from the electron emitting construct 12 strikes the electron receiving construct 14, radiation of a predetermined spectrum determined by the makeup of the radiation source 72, e.g., x-rays, is produced.

According to the presently disclosed subject matter, the focus electrode 24 serves as a shield to the control contact 42, 44 and their respective connections to the emitter drive pads 52. This may be particularly useful, for example, in high-voltage applications which utilize the emitter such as an x-ray source, wherein the burn-in process required prior to its operation (e.g., to create a vacuum) may result in discharges which may cause damage to the emitter chip.

Although the foregoing description with reference to the accompanying drawings was directed toward an electron emitting construct for an image capture device or an x-ray emitter, one skilled in the art will immediately recognize its utility for use in other applications, mutatis mutandis.

The structure defined here in may facilitate the use of cold cathode technologies, for example for producing x-ray fields.

Those skilled in the art to which presently disclosed subject matter pertains will readily appreciate that numerous changes, variations and modifications can be made without departing from the scope of the present disclosure mutatis mutandis.

Other aspects of the present disclosure relate to an electron emitting construct operable to emit at least one electron beam where the electron beam is focused and accelerated by an electrical field towards a focal spot on an electron anode target. The electron emitting construct may be configured to avoid ion bombardment damage to a cold cathode substrate. Accordingly, the cold cathode may have distinct electron emitting and non-emitting zones.

The emitter of an x-ray source, such as a cold cathode, is operable to emit an electron beam toward the electron anode target. The high current of electrons (30 to 500 mA for medical x-ray) upon colliding at the target, may cause the target to be heated up to 2,000 degrees in Celsius, accordingly, x-rays are emitted from the electron anode target. Such an electron anode target may be fabricated, for example, from tungsten or molybdenum or the like.

Due to the high temperatures and low pressures involved the material of the target may be vaporized around the focal spot of the electrons. Vaporized metal atoms in the path of the electron beam adjacent to the electron anode target may be readily ionized by the high energy electrons. The high voltages between the electron anode target and the cathode which may be of the order to say 30 kV to 150 kV may give rise to strong electric fields particularly in the region adjacent to the positively charged electron anode target where ionization occurs.

Accordingly, metal anions produced in the region adjacent to the electron anode target may be strongly accelerated away from the electron anode target along a line perpendicular to the local electric field, which is typically parallel to the surface of the electron anode target. The accelerated ions form an ion beam directed along a trajectory perpendicular to the electric field adjacent to the electron anode target. When the cold cathode is disposed along the trajectory, of the ion beam it is vulnerable to ion bombardment damage.

The current disclosure introduces embodiments of cold cathode x-ray emitters configured to prevent ions in the high voltage vacuum from bombarding the cold cathode by deviating the ion beam away from the vulnerable cold cathode and towards a dedicated and distinct ion collection zone such that no micro structures are damaged. Such design may be crucial for application of the cold cathode in medical x-ray sources.

Various aspects of the current disclosure include segmented cathodes having distinct emitting and non-emitting zones, angled electron anode targets, stepped electron anode targets and the like operable to further direct the ion trajectory away from the emitting zone of the cold cathode in order to reduce the damage of ion bombardment.

Figure 6B:
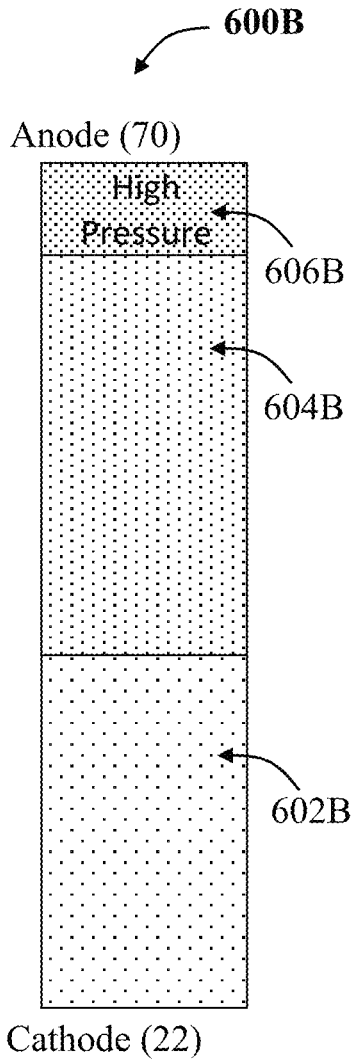
FIG. 6B is a schematic representation of ion pressure distribution between the electron emitting cathode and the anode target of the x-ray emitter apparatus, when an electron beam is accelerated toward the anode target and metal vapor released from the target is partially ionized.
Figure 6A:
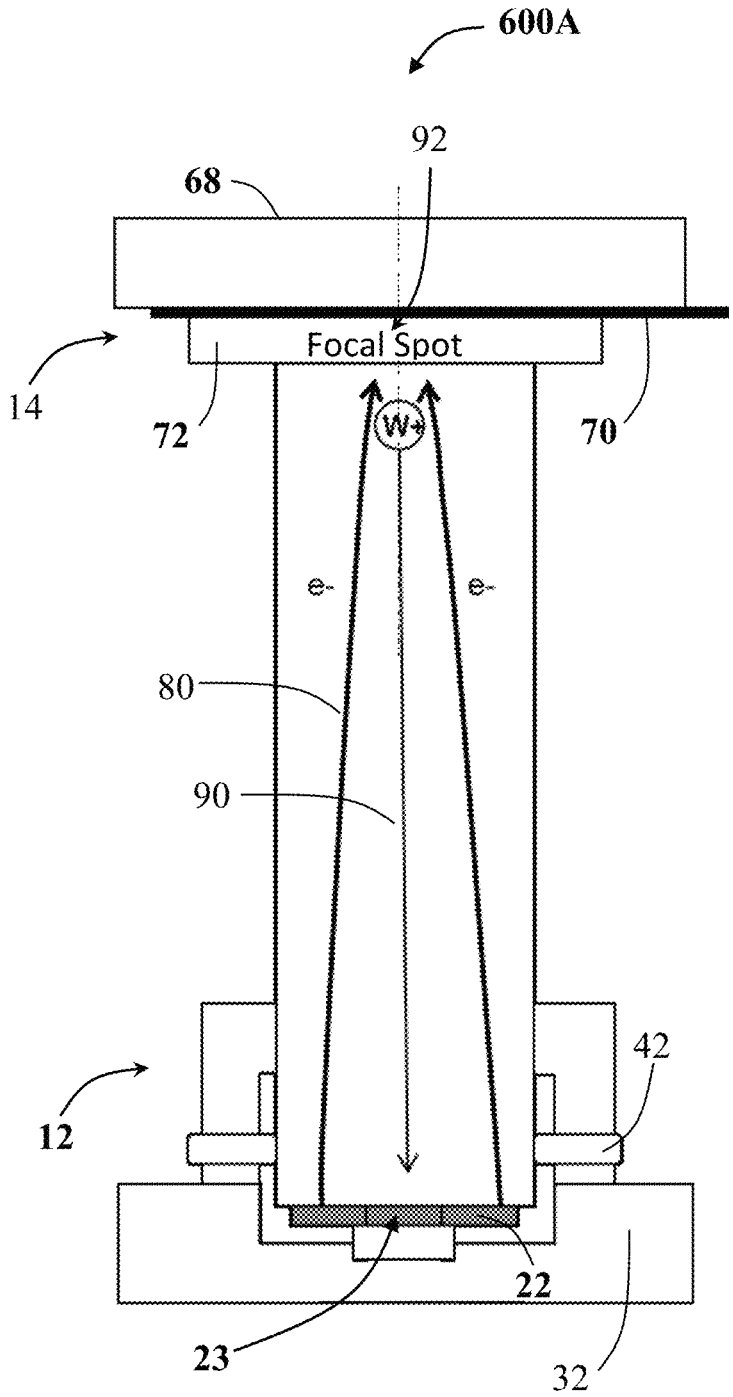
FIG. 6A is a schematic drawing of an embodiment of bombardment resistant cold cathode x-ray emitter apparatus.

Electron Beam Distribution:

As illustrated schematically in FIG. 6A, showing a possible technical configuration for a bombardment resistant device 600A, such as an x-ray emitter, an image capturing device and the like.

The bombardment resistant device 600A includes an electron emitting construct 12, including a cold cathode of the emitter, and an electron receiving construct 14, including an electron anode target of the emitter. The electron emitting construct 12 comprises a substrate 32, a cold cathode 22 and a focus structure 42 configured for emitting an electron beam 80 toward the electron receiving construct 14, which then produces radiation in a predetermined spectrum.

The electron emitting construct 12 further comprises an emitter chip such as illustrated below in FIG. 13A.

The electron receiving construct 14, may be provided according to any suitable configuration. As illustrated in FIG. 6A, one embodiment of the electron receiving construct 14 may comprise a faceplate 68, an anode 70, and a radiation source 72, such as a metal target in the case of an x-ray emitter, as is known in the art. The electrons are directed to a focal spot 92 of the target.

Vaporized metal may be ionized forming an ion beam 90 emanating from the focal spot and directed away from the target. Ion bombardment may cause damage even to a conventional metal filament cathode of a conventional x-ray emitter. It is particularly noted that cold cathode emitter is particularly vulnerable, and the bombardment may severely destroy the micro structure of a cold cathode. To avoid such damage the cold cathode 22 of the bombardment resistant emitter may comprise an electron emitting zone and a non-emitter zone, as described hereinafter. The non-emitter zone 23 may be disposed along a line extending from the focal spot perpendicular to the surface of the electron anode target to receive the ionized heavy metal, accelerated by the high voltage electric field between the anode and the cathode.

Aspects of the current disclosure, applied to the cold cathode as described hereinafter and to the target anode, will deviate the ion beam in the high voltage vacuum from the direction of the vulnerable cold cathode and collide towards a collection zone such that no micro structures are damaged. Thus, implementation of the current disclosure may facilitate the application of the cold cathode in medical x-ray sources.

As illustrated schematically in FIG. 6B, showing a possible pressure distribution 600B between the electron anode target 70 and the cold cathode 22 of the device configuration.

The pressure distribution of the device configuration (600A, FIG. 6A) provides low gas pressure in the region 602B in the vicinity of the cold cathode 22, increasing in the region of 604B and resulting in higher gas pressure in the region 606B in the vicinity of the anode 70.

It is noted that some of the gas molecules are ionized by electron bombardment and the generated ions are accelerated by the electric field back towards the emitters along a line from the focal spot.

Figure 7:
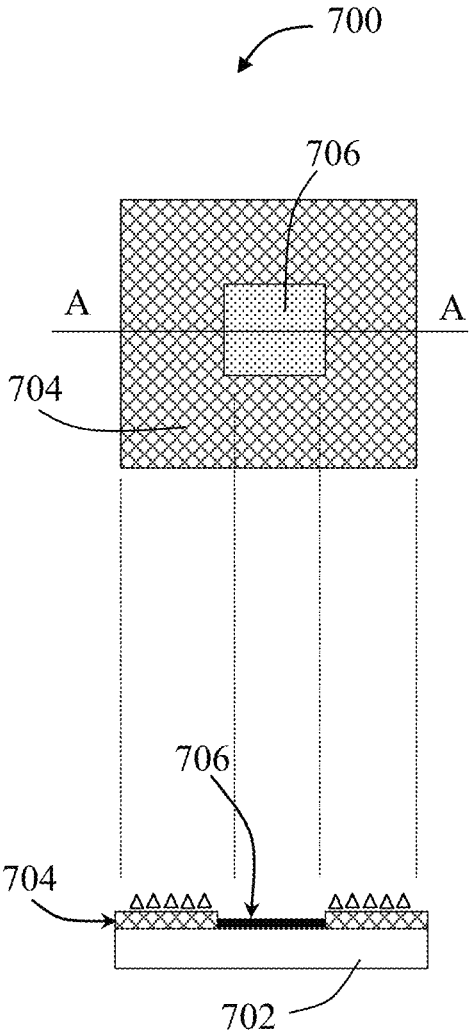
FIG. 7 represents a top view and cross section of a first embodiment of an electron emitting cathode of an x-ray emitter having a non-emitting ion collection zone surrounded by an emitting zone.

Emitter Possible Configurations:

As illustrated in FIG. 7, showing a top view and cross section of a possible cold cathode configuration for an electron emitter 700, having a centered squared non-emitter zone 706 surrounded by the emitter zone 704 of an x-ray emitter device.

The electron emitter 700 includes the substrate 702 (sectional view), the emitter zone 704 and the non-emitter zone 706. The non-emitter zone 706 is configured to be surrounded by the emitter zone 704 such that ion bombardment does not occur on the emitter area 704 therefore preventing bombardment damage thereto.

It is particularly noted that the non-emitter zone 706 material may be fabricated from or coated by materials that do not contain oxygen such as pure metal, carbon or various carbon elements such as a C:H layer, for example.

Further, the size of the non-emitter zone 706 may be larger than that of electron focal spot. Accordingly, a spreading ion beam emanating from the focal spot may be collected within the non-emitter zone 706 without spreading significantly into the emitting zone 704.

As appropriate the focus structure 42 (FIG. 6A) should be disposed between the emitter zone and the electron anode target perhaps surrounding the emitting mechanism. Accordingly, the electron beam may be focused from the emitting zone towards the focal spot aligned along a line perpendicular from the target to the non-emitter zone 702. It will be appreciated that the electrons may be directed by the focus structure may direct the electrons to strike the focal spot at an angle to the normal.

It will be appreciated that although the squared sectional view of the cold cathode substrate is presented by way of example only and various other configurations may be applicable. Such examples are detailed further, in the FIGS. 8A-C, as described hereinafter.

Optionally, the emitter zone may be made of additional emitting elements, to allow the non-emitter zone to be fully enclosed or to be placed in between emitter zone elements.

Figure 8A:
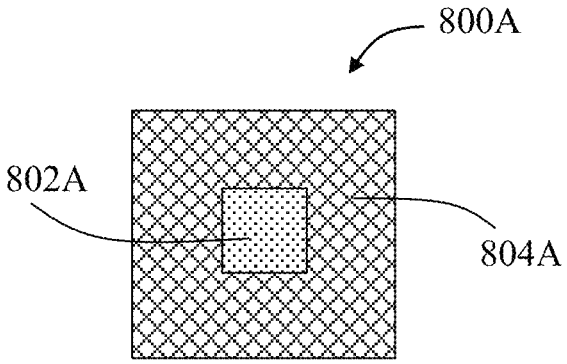
FIG. 8A is a top view plan of a square emitter configuration having a square non-emitting ion collection zone surrounded by the emitting zone.
Figure 8B:
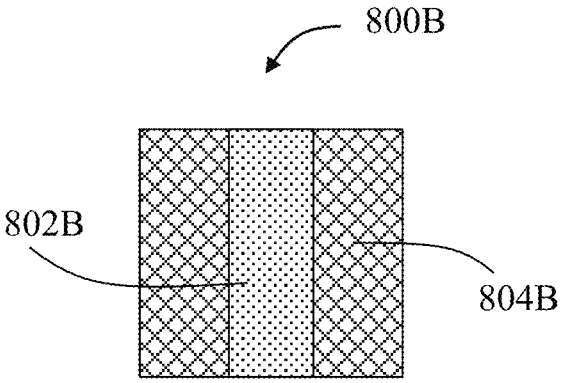
FIG. 8B is a top view plan of a rectangular emitter configuration having a rectangular non-emitting ion collection zone arranged between two emitting zones.
Figure 8C:
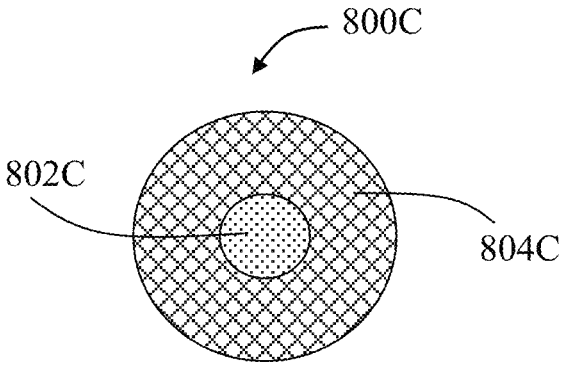
FIG. 8C is a top view plan of a circular emitter configuration having a circular non-emitting ion collection zone surrounded by a circular emitting zone.

As illustrated in FIGS. 8A, 8B and 8C, are schematic drawings of various cold cathodes configurations of the emitting construct operable as an x-ray source, according to the presently disclosed subject matter. The various designs are intended to reduce substantially the possible ion bombardment damage, generated near the electron anode target, in an x-ray emitter device such as x-ray tube, for example.

FIG. 8A illustrates a top view 800A of rectangular configuration of a cold cathode, having a square emitting zone 802A and a square non-emitting zone 804A.

FIG. 8B illustrates a top view 800B of rectangular configuration of a cold cathode, having a rectangular emitting zone 802B and a square non-emitting zone 804B.

FIG. 8C illustrates a top view 800C of circular configuration of a cold cathode, having a circular emitting zone 802B and a circular non-emitting zone 804A.

It is note that the various cold cathode substrate designs, as described in FIGS. 8A-C, are brought in by way of example. Additionally or alternatively, various other design may be applicable providing a shaped emitting zone and a shaped non-emitting zone, with appropriate zone sizes.

It is further noted that any of the non-emitting zone size, such as the size of 802A (of FIG. 8A) is larger than that of the electron focal spot, surrounded by or set between the emitter zones.

Figure 9:
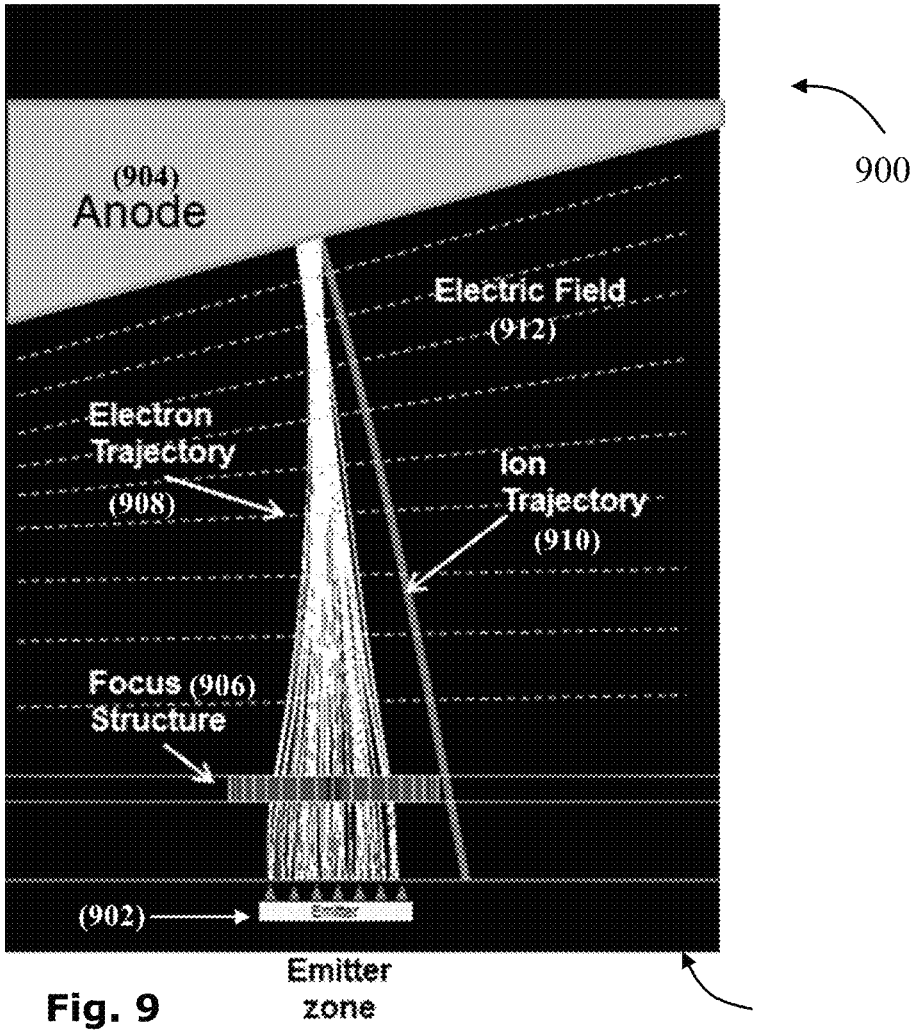
FIG. 9 illustrates a second embodiment of a bombardment resistant cold cathode x-ray emitter apparatus including an angled target anode.

Stepped/Angled Anode:

Reference is now made to FIG. 9 showing a second embodiment of a bombardment resistant device configuration 900 and indicating a possible electron beam and ion beam simulation. The device configuration 900 may be applicable for devices such as an x-ray emitter, an image capturing device and the like.

The device configuration 900 of the second embodiment includes an electron emitter 902, configured for emitting an electron beam in a trajectory 908 via a focus structure 906 to an angled target anode 904. It is noted that the angled target anode 904 produces a local electric field 912 largely parallel to the surface of the angled target 904. Accordingly, the ions are accelerated along a trajectory 910 perpendicular to the local electric field and away from the electron emitter such that the emitter substrate is not hit, thereby preventing possible ion bombardment damage.

It is noted that a cold cathode electron gun for x-ray source may comprise a focus structure directing the electron beam toward the target anode focal spot. The second embodiment of the current disclosure may include an angled target anode 904 configured such that ion beam is directed away from the electron emitting construct. Accordingly, the distance between the target anode and the cathode, and the target angle, are selected such that the striking point 911 of the ion beam is lies away from the emitter zones 902 or the focus structure 906.

In the drawing figures hereafter, various simulations are indicated illustrating the impact of various angled anode and the relevant impact of shifting away the ion trajectory.

It is particularly noted that the anode may be configured to be tilted at an angle to the emitting substrate plane, such that the emitted electron beam hitting the focal spot on the angled target anode area with the electrons to striking the focal spot at an angle to the normal.

As the electrons are accelerated and hit the target anode, temperature of the focal spot increases substantially (up to 2000 degrees in Celsius) and the anode materials may partially vaporized. Further, some of the vapor atoms may be ionized by the electron beam. The ions, which are generated near the target anode surface have low initial velocity and may be accelerated along a trajectory perpendicular to the local electric field which is parallel to the tilted anode plane, such that the ion beam lands outside of the emitter zone.

It is noted that the position, angle and distance between the target anode, the cold cathode emitter and the focus structure may be selected in a manner such that ion bombardment damage is prevented to the emitter region.

Figure 10A:
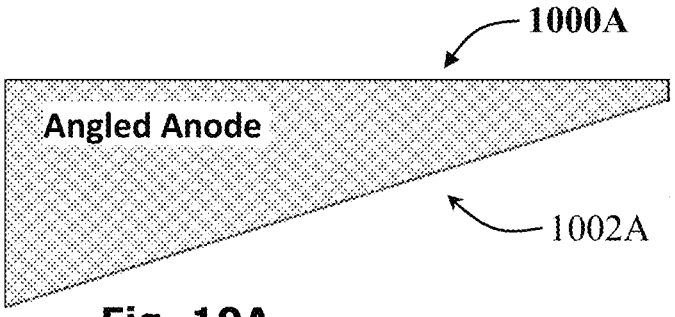
FIG. 10A is an illustration of an angled anode.
Figure 10B:
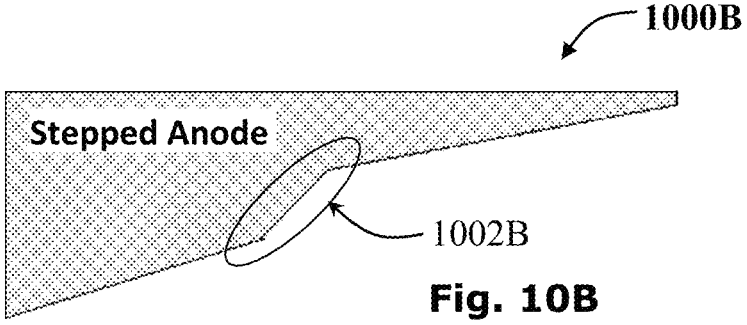
FIG. 10B is an illustration of a stepped anode.

As illustrated in the FIGS. 10A and 10B, the receiving construct (the electron anode target) comprising an angled anode (404, FIG. 9) may be an angled surface relative to the electron emitting substrate surface (402, FIG. 9).

FIG. 10A showing a possible design 1000A and illustrates such angled anode 1002A, where the angle of the surface determines the ion trajectory 910 (of FIG. 9), which is perpendicular to the local electric fields adjacent to the surface of the angled target anode which are largely parallel to the angled surface of the anode.

FIG. 10B showing a possible design 1000B where the angled surface comprises a stepped angled surface 1002B, configured to have a step within the surface of the angled anode forming a stepped anode.

It was surprisingly found during simulations that a step along the angled surface of the anode, even with a small step of 1 mm in size, makes the electric field near the electron target anode more asymmetrical causing the ions to be accelerated along a trajectory having a greater deflection angle such that the ions to be shifted further outward than those deflected by an angled anode with no step.

It will be appreciated that although a straight sided stepped surface is represented in FIG. 10B for illustrative purposes only. Other embodiments (NOT SHOWN) may have straight or curved steps as required. Such steps include, but are not limited to, steps having concave surface sections, convex surface sections, undulating surface section, saw-tooth surface sections or the like as well as combinations thereof as suit requirements.

It is further noted that the step location may have greater effect on deviating the ion beam, if located close to the target anode focal spot.

Accordingly, an x-ray emitter device configured with a stepped anode, may have the characteristics such as: The anode may be configured with at least one step, The step may be located close to the electron anode target focal spot towards which the electron beam is directed by the focus structure, The non-emitter zone or focus structure is fabricated from or coated with pure metal which may be the same material as the anode material like Mo or W, The non-emitter zone or focus structure is fabricated from or coated with carbon materials such as carbon, carbon nanotube (CNT), or diamond-like carbon (DLC) coating.

Figure 11:
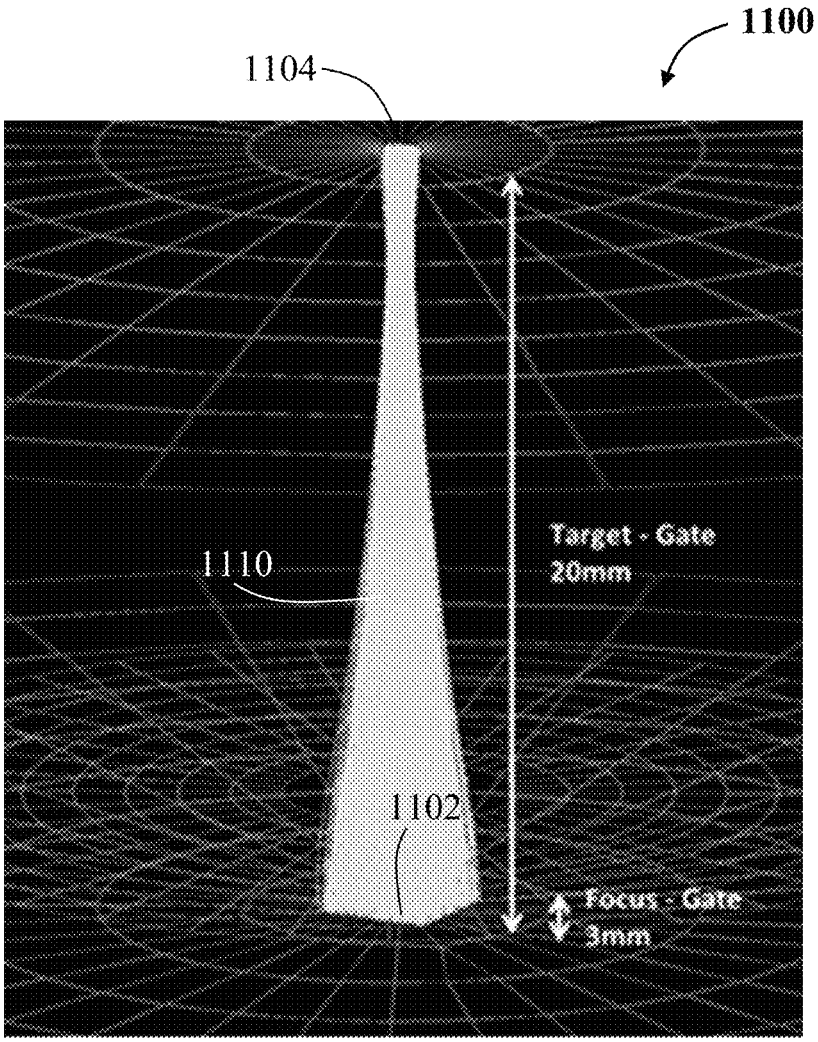
FIG. 11 is an illustration of a beam landing simulation configuration.

Beam Landing Simulation:

Reference is now made to FIG. 11, showing a beam landing simulation 1100 configuration. The beam landing simulation is carried for a device having an emitting construct comprising a cold cathode 1102 with a focus gate of 3 mm forming an electron beam 1110 directed toward a target anode 1104 at a distance of 20 mm.

Figure 12A:
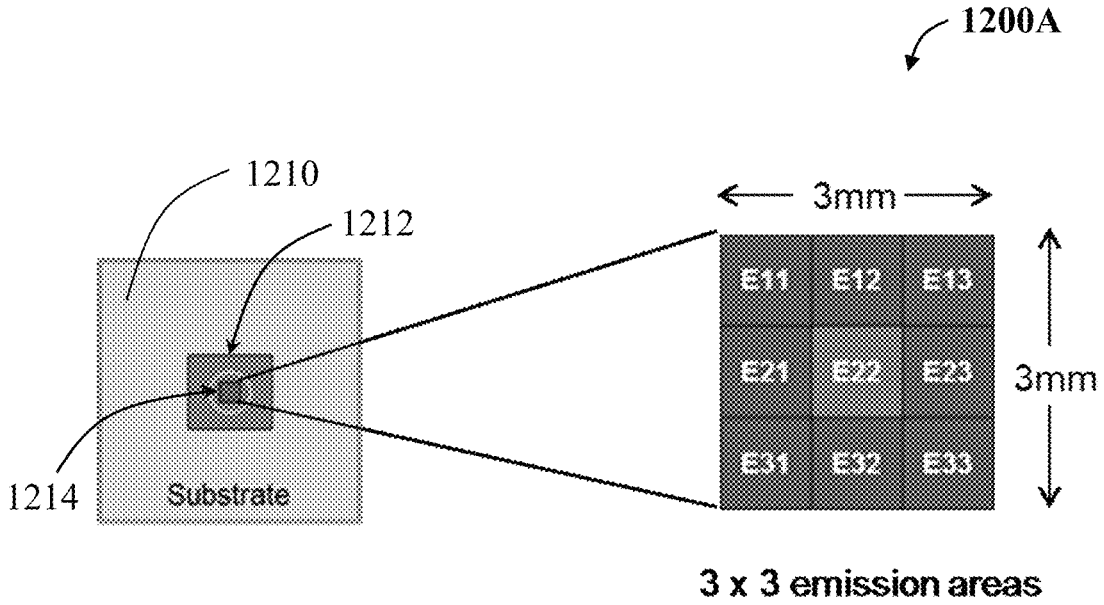
FIG. 12A is a represents a possible emitter chip of the system.

Referring now to FIG. 12A showing an emitter embodiment 1200A having an emitter chip 1212 is illustrated mounted upon a substrate 1210. The emitter chip 1212 includes nine distinct zones E11, E12, E13, E21, E22, E23, E31, E32, E33 arranged in a three by three array. These zones may correspond to row and column control contacts (not shown) of the emitter chip 1214, The chip-mounting surface of the emitter chip 1212 may have dimensions of 3 mm by 3 mm. It is noted the emitter chip include an electron emitting zone and a distinct non-emitting ion bombardment zone. The emitting zone, for example may comprise the 8 perimeter zones E11, E12, E13, E21, E23, E31, E32, E33 whereas the central zone E22 may be a dedicated non-emitting ion bombardment zone.

Figure 12B:
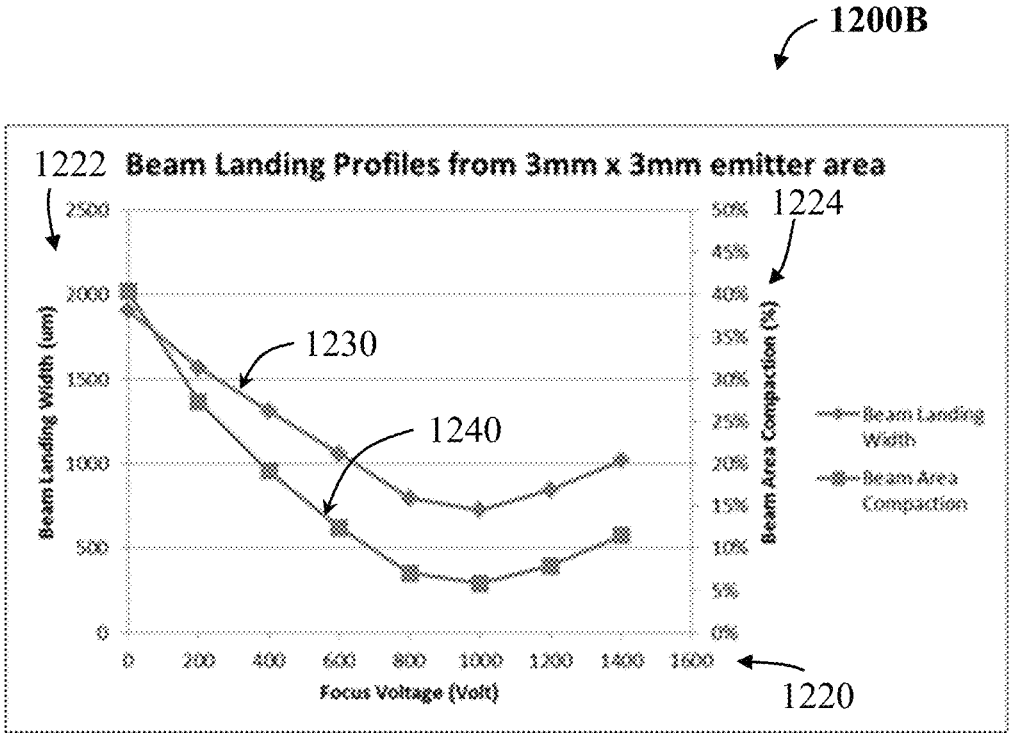
FIG. 12B is a graph presenting the results of a simulation showing ion landing simulation on a different anode-cathode distance using 1 mm diameter of electron beam focal spot size.

As illustrated in FIG. 12B, the graph of the beam landing profile 1200B from a 3 mm by 3 mm emitting area, is represented by two plots: the beam landing width 1230 plotted in micrometer units (vertical axis 1222) and the beam area compaction 1240 measured in percentage (vertical axis 1224) and plotted against a horizontal axis of focus voltage 1220 measured in volts.

Figure 13A:
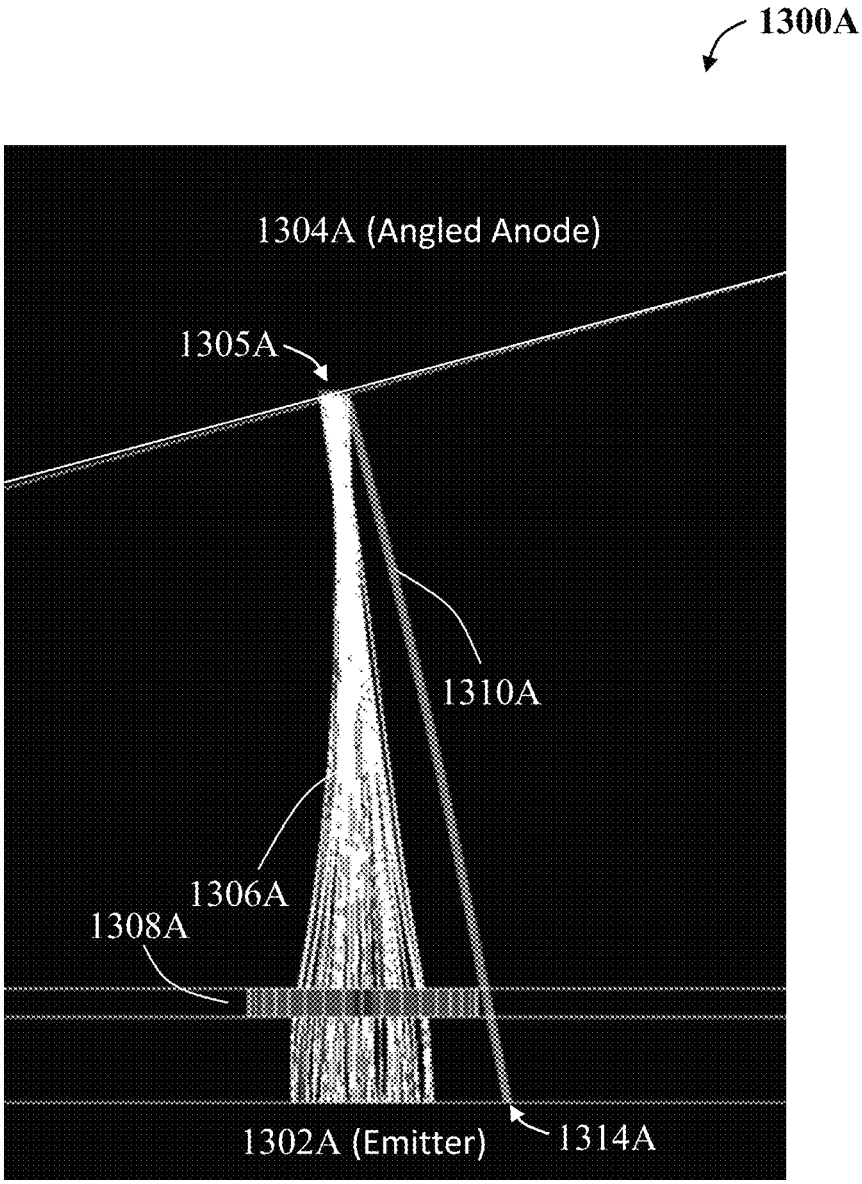
FIGS. 13A and 13B illustrate selected electron beam simulation for different anode surface angles.
Figure 13B:
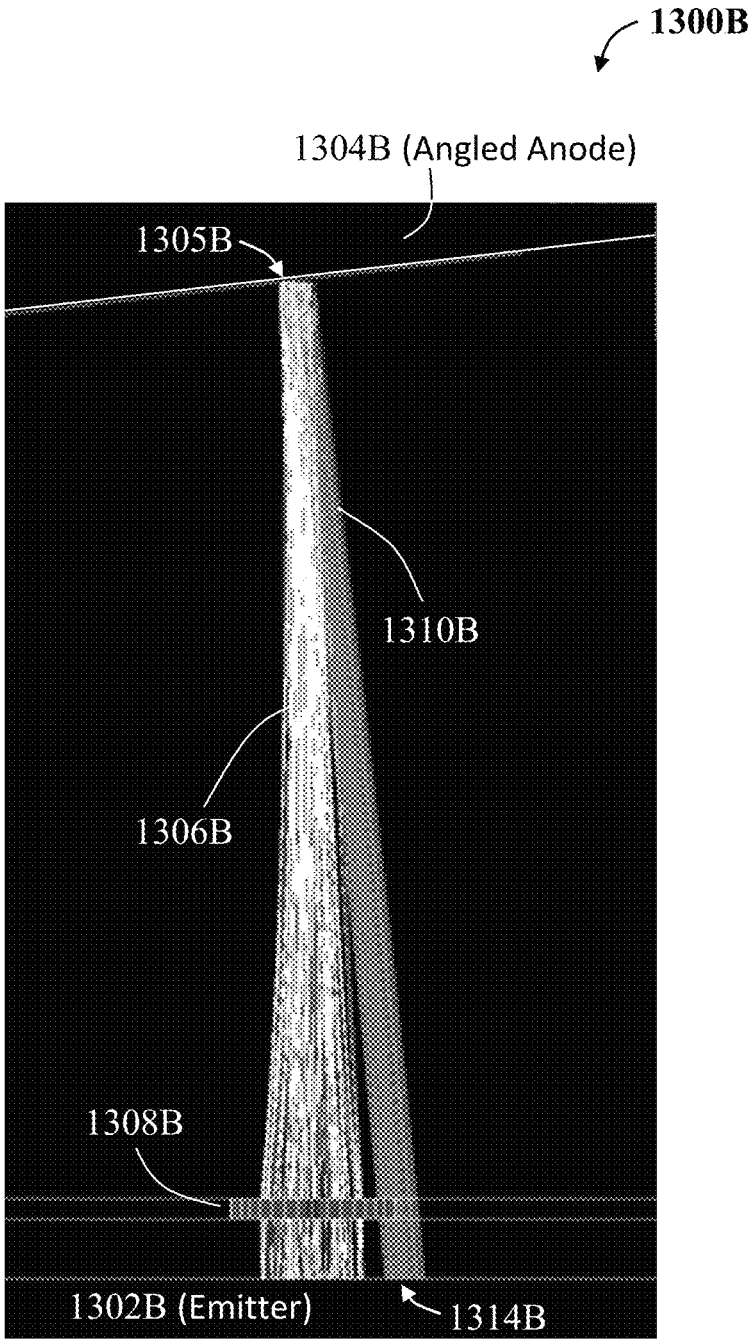

Beam Simulation Configuration & Results:

Referring now to FIGS. 13A and 13B, a beam simulation is illustrated, for various configurations of the electron emitter. In particular, FIG. 13A, shows a simulation of an angled anode configured at 16 degrees and FIG. 13B shows a simulation of an angled anode configured at 7 degrees.

FIG. 13A illustrates a beam simulation configuration 1300A for an angled anode, resulting in an ion trajectory reducing the effect of ion bombardment damage. The beam simulation 1300A includes an emitter 1302A, emitting electron beam 1306A to an angled anode 1304A.

The setup parameters of the beam simulation configuration 1300A, refer to an anode surface angle of 16 degrees, emitter-anode distance of 25 mm and emitter-focus distance of 3 mm.

The electron beam 1306A is directed by via a focus structure 1308A towards a focus spot 1305A on the angled anode 1304A thereby generating causing an ion beam 1310A along a trajectory perpendicular to the local electric field adjacent to the angled anode striking the plane of the emitter at an ion landing area 1314A.

FIG. 13B illustrates another beam simulation configuration 1300B for an angled anode, resulting in an ion trajectory reducing the effect of ion bombardment damages. The beam simulation configuration 1300B includes an emitter 1302B, emitting electron beam 1306B to an angled anode 1304B.

The configuration parameters of the beam simulation configuration 1300B, refer to an anode surface angle of 7 degrees, emitter—anode distance of 50 mm and emitter—focus distance of 3 mm.

The electron beam 1306B is directed by via a focus structure 1308B towards a focus spot 1305B on the angled anode 1304B thereby generating causing an ion beam 1310A along a trajectory perpendicular to the local electric field adjacent to the angled anode striking the plane of the emitter at an ion landing area 1314B.

It is noted that each configuration of anode surface angle relative to the cathode surface and distance from the cathode to the anode produces a characteristic ion landing spot as described in the figures hereinafter. It is a feature of this embodiment of the current disclosure that the parameters of the configuration are selected such that the ion landing area 1314A, 1314B lies outside the electron emitting zone.

Figure 14A:
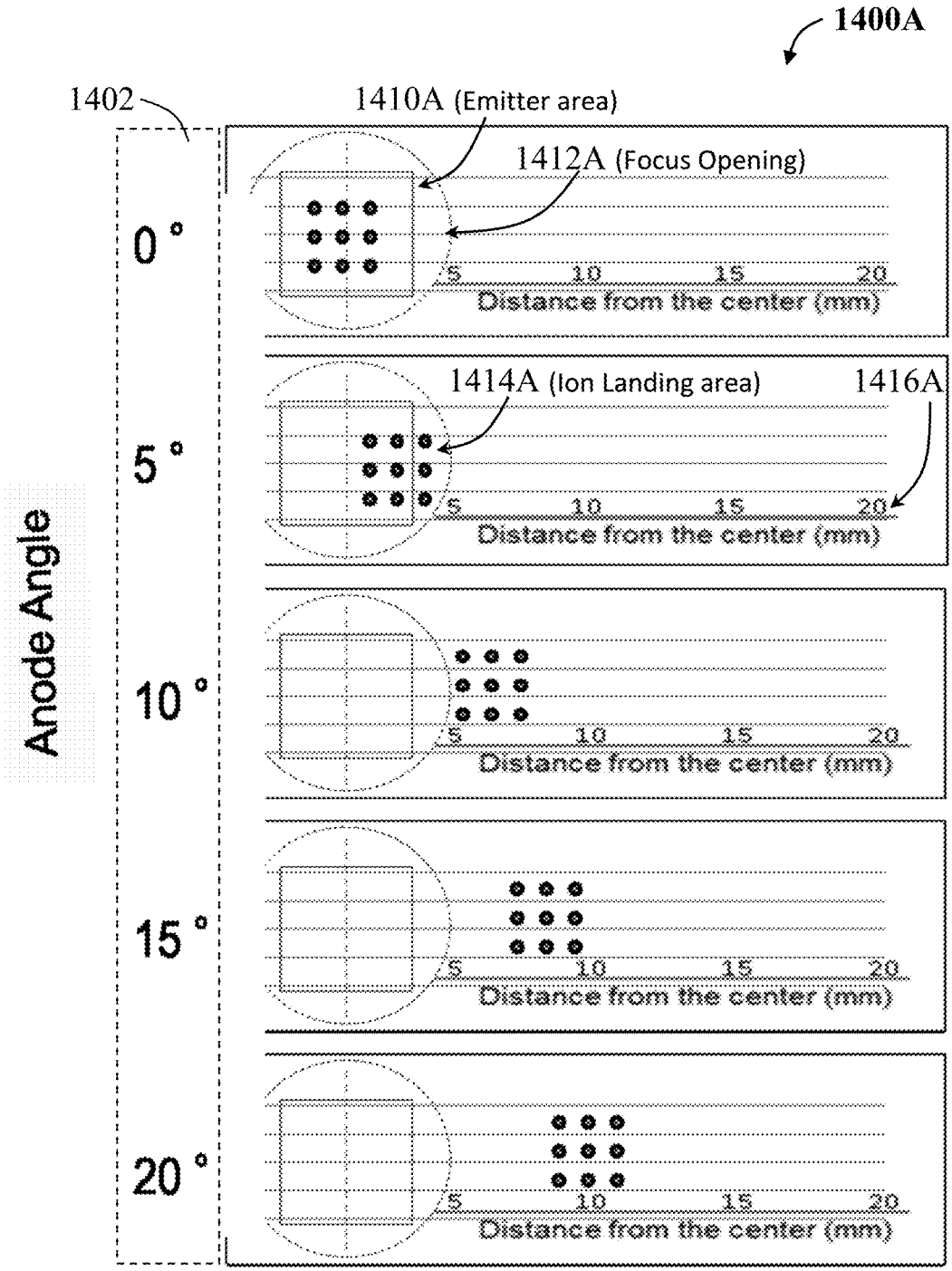
FIG. 14A is a schematic presentation of beam landing simulation results for various electron anode angles.

As illustrated in FIG. 14A, a result summary 1400A is provided for the beam simulation of an angled target anode. The result summary 1400A covers ion landing simulation configurations for various angled target anode surfaces from 0 degrees to 20 degrees, in steps of 5 degrees, and at distance of 30 mm between anode and cathode, illustrating the ion beam landing away from its cathode center.

Each plot of the summary result set 1400A, presents ion landing distance results at a specific anode angle 1402. The distance in mm away from the cold cathode center is indicated on an associated horizontal distance axis 1416A. The summary result set 1400A provides an emitter area indication 1410A, a focus opening indication 1412A and ion landing area indication 1414A, where each indication is measured in millimeter distance from the center of the emitter area 1410A.

It has been found that the larger the angle of the anode to the plane of the cathode, the farther ion beam landing area from the cold cathode center.

It is noted that the summary result set 1400A presented, is plotted for a fixed distance between the cathode and anode of 30 mm, while the anode surface angle is set at a different angle for each ion landing measurement.

Figure 14B:
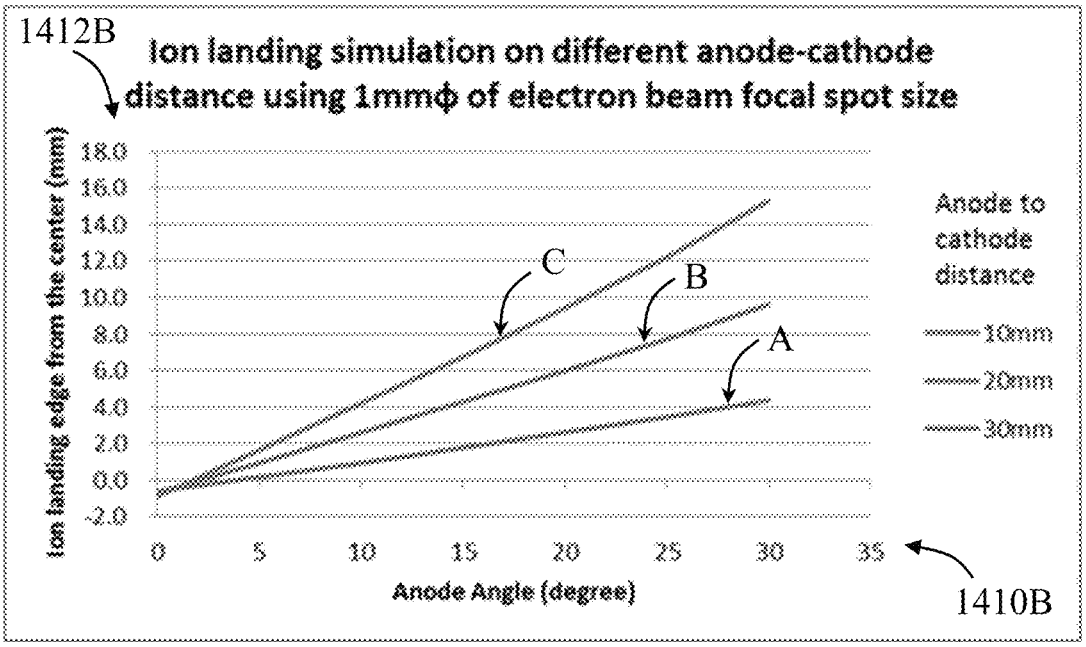
FIG. 14B is a graph presenting the results of a beam landing simulation on various anode-cathode distances using a 1 mm diameter of electron beam focal spot size.

As illustrated in FIG. 14B, the ion landing simulation results are presented for various distance values between the cathode and the angled anode.

The ion landing simulation results 1400B of FIG. 14B refers to various anode-cathode distance configurations, using a 1 mm diameter of electron beam focal spot size. The plot of the ion landing simulation results 1400B is plotted on a horizontal axis of anode angle 1410B, measured in degrees vs. an ion landing edge from the center 1412B, measured in mm.

As illustrated in FIG. 14B, plot A provides the ion landing for an anode-cathode distance of 10 mm, plot B provides the ion landing behavior for an anode-cathode distance of 20 mm and plot A provides the ion landing behavior for a anode-cathode distance of 30 mm.

Figure 15A:
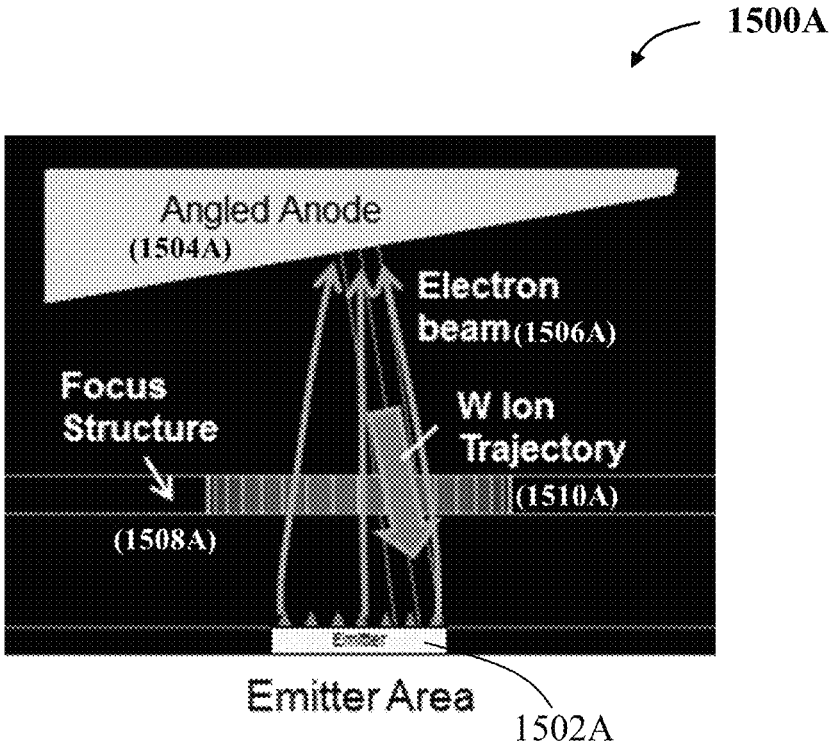
FIGS. 15A and 15B illustrate ion trajectory differences between an angled anode and a stepped anode.
Figure 15B:
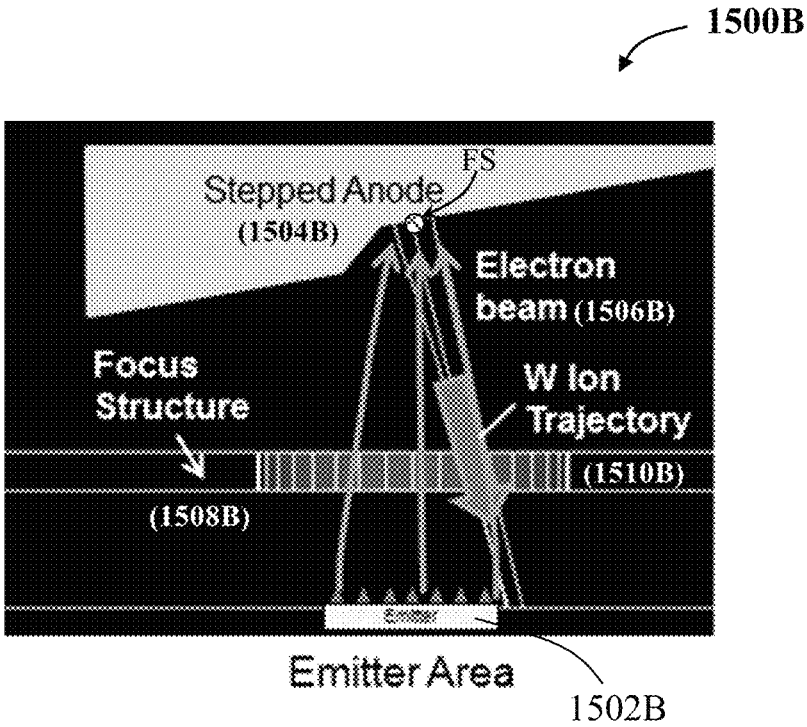

Referring now to FIGS. 15A and 15B, a surprising result of the simulation is presented relating to a stepped anode. A configuration was simulated having a stepped anode with a step height of 1 mm directional along a z axis, showing that even such a small step influences the shift of ion trajectory further outside.

FIGS. 15A and 15B illustrated the ion trajectory difference between a smooth angled target anode and a stepped angled target anode.

FIG. 15A represents an x-ray emitter device 1500A with an electron angled anode of the electron receiving construct (the electron anode target). The emitter device 1500A includes an emitter 1502A emitting an electron beam 1506A to an angled anode 1504A via a focus structure 1508A, driving the accelerated ions along a trajectory perpendicular to the electric field, adjacent to the surface of the anode.

FIG. 15B represents another aspect of the invention, using a stepped anode, allowing an additional improved design option compared to the angled anode as illustrated in FIG. 15A.

FIG. 15B represents an x-ray emitter device 1500B with a stepped anode of the electron receiving construct. The emitter device 1500B includes an emitter 1502B emitting an electron beam 1506B to a stepped anode 1504B via a focus structure 1508B, driving the accelerated ions along a trajectory perpendicular to the electric field, which is parallel to the surface of the anode. Yet, as illustrated, the stepped anode is capable of driving the accelerated ion along a trajectory 1510B, which is further away compared to the trajectory 1510A, as indicated in FIG. 10A. Thus, further reduces the possible damage due to the ion bombardment.

It is noted that the step introduced into the angled target anode, making a stepped target anode, makes the electric field near the anode 1504B (FIG. 15B) more asymmetrical, forcing the ions trajectory to shift outward.

It is further surprisingly noted that the location of the step along the anode surface may be configured to be outside and close to the electron beam focal spot FS so as to obtain a large deflection of the ion beam trajectory.

Figure 16A:
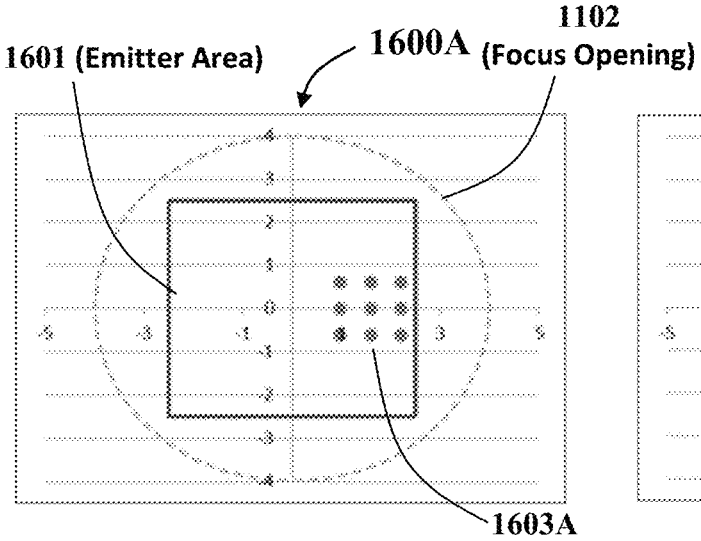
FIGS. 16A and 16B illustrate ion landing spot differences between an angled electron anode and a stepped electron anode.
Figure 16B:
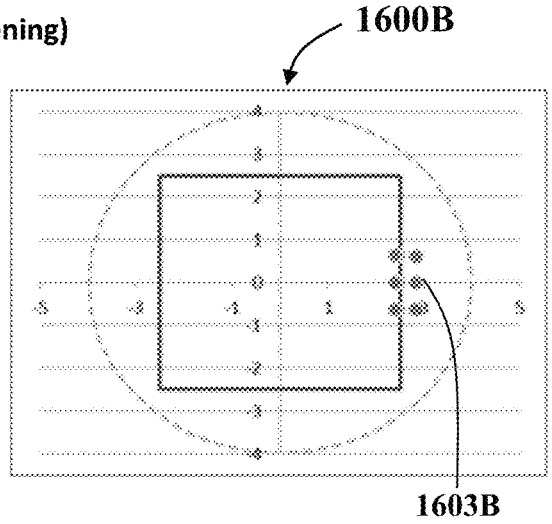

Referring now to FIGS. 16A and 16B, the ion landing spot trajectory shift away is provided for an angled anode compared to a stepped anode. The configuration parameters for this simulation include an anode-cathode distance of 10 mm, an angled anode at 10 degrees and applied anode voltage of 30 kV.

FIG. 16A represents the simulation results of ion landing spot 1600A using a smooth angled anode of an x-ray emitter device 1500A (of FIG. 15A). The ion landing spot results 1600A indicates the emitter area 1603A, the focus opening 1602, and the position of the ion landing area 1603A, which is towards the edge of the emitter area 1601.

FIG. 16B represents simulation results of ion landing spot 1600B using a stepped anode of an x-ray emitter device 1000B (of FIG. 15B). It is particularly noted that the ion landing spot results 1600B indicate the position of the ion landing area 1603B, which is further away than the hit location 1603A of FIG. 16A.

Figure 17:
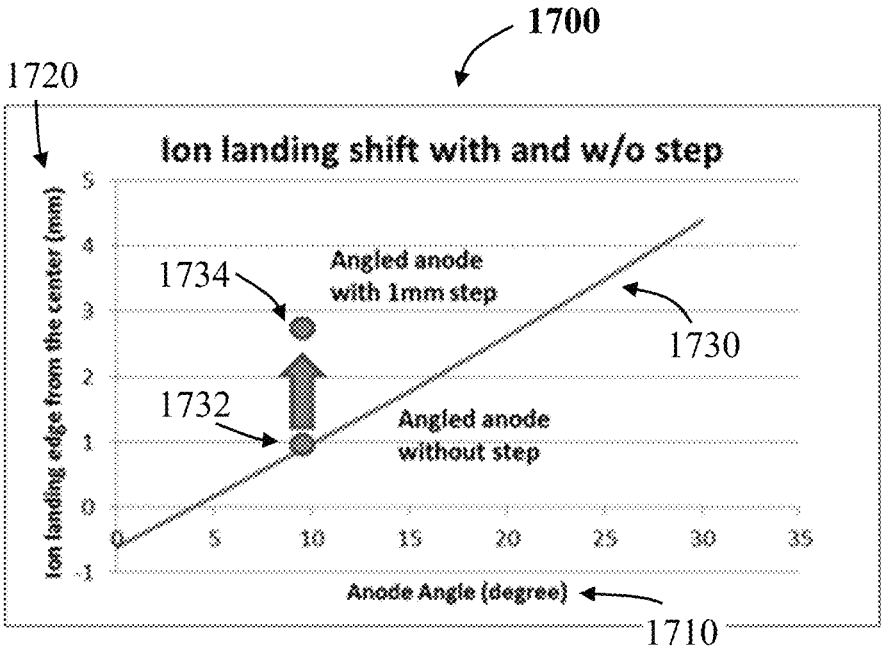
FIG. 17 is a graph presenting the results of a simulation showing the shift of the ion landing spot using an angled anode, with and without a step.

As illustrated in FIG. 17, the ion landing shift with and without a step is indicated on a graph 1700. The data of graph 1700 is presented in a data line 1730, as distance in millimeters of the ion landing edge from center (vertical axis 1720) for each anode angle in degrees (axis of anode angle 1710).

Thus, the point location 1732, for example indicates an angled anode at 10 degrees resulting in a point location of 1 mm away from the center of the emitter area, while point location 1734, and indicates an offset of 3 mm away from the center of the emitter area using a step in the anode of 1 mm in size.

Technical and scientific terms used herein should have the same meaning as commonly understood by one of ordinary skill in the art to which the disclosure pertains. Nevertheless, it is expected that during the life of a patent maturing from this application many relevant systems and methods will be developed. Accordingly, the scope of the terms such as computing unit, network, display, memory, server and the like are intended to include all such new technologies a priori.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Although the disclosure has been described in conjunction with specific examples thereof, it is evident that many alternatives, modifications and variations will be apparent to those skilled in the art. Accordingly, it is intended to embrace all such alternatives, modifications and variations that fall within the spirit and broad scope of the disclosure.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure. To the extent that section headings are used, they should not be construed as necessarily limiting.

What is claimed is:

1. An x-ray emitting device comprising:

an electron anode target; and a cold cathode electron source having at least one electron emitting zone configured to emit electrons towards said electron anode target, and at least one non-emitting ion bombardment zone, wherein said at least one electron emitting zone further comprises an electrically insulating substrate, an array of nano-Spindt field emission type electron sources, a plurality of control contacts configured for controlling said electron sources, a focus electrode configured for applying a voltage above said array, and a shield disposed over said control contacts, said shield constituting part of the focus electrode, and wherein said at least one non-emitting ion bombardment zone is disposed along a line perpendicular to the surface of said electron anode target; said at least one ion bombardment zone being distinct from said electron emitting zone of said cold cathode electron source.

2. The x-ray emitter device of claim 1, further comprising a focus structure configured to direct electron towards said electron anode target such that said electrons strike an electron focal spot at an angle.

3. The x-ray emitter device of claim 2, wherein said at least one ion bombardment zone is disposed along a line perpendicular to the surface of said electron anode target at said electron focal spot.

4. The x-ray emitter device of claim 2, wherein said at least one ion bombardment zone has larger dimensions than said electron focal spot.

5. The x-ray emitter device of claim 2, wherein said at least one ion bombardment zone is coated with an elemental material.

6. The x-ray emitter device of claim 5, wherein said elemental material comprises a pure metal.

7. The x-ray emitter device of claim 5, wherein said elemental material comprises carbon.

8. The x-ray emitter device of claim 2, wherein said at least one ion bombardment zone comprises a central region surrounded by said electron emitting zone of said cold cathode electron source.

9. The x-ray emitter device of claim 2, wherein the electrically insulating substrate is silicon-based.

* * * * *